US006364784B1

(12) United States Patent
Fuhre

(10) Patent No.: US 6,364,784 B1
(45) Date of Patent: Apr. 2, 2002

(54) GOLF PRACTICE DEVICE WITH MARKING WHEEL

(76) Inventor: Leo Maynard Fuhre, 113-437 Martin St., Suite # 275, Penticton, B.C. (CA), V2A 5L1

( * ) Notice: Subject to any disclaimer, the term of this patent is extended or adjusted under 35 U.S.C. 154(b) by 0 days.

(21) Appl. No.: 09/590,472

(22) Filed: Jun. 9, 2000

Related U.S. Application Data

(60) Provisional application No. 60/140,934, filed on Jun. 28, 1999.

(51) Int. Cl.[7] ..... A63B 69/36
(52) U.S. Cl. ..... 473/146
(58) Field of Search ..... 473/145, 146, 473/149, 219, 231, 237

(56) References Cited

U.S. PATENT DOCUMENTS 3,081,091 A * 3/1963 Grow ..... 473/237 X
4,432,551 A * 2/1984 Chen ..... 473/237 X
5,082,284 A * 1/1992 Reed ..... 473/235
5,120,358 A * 6/1992 Pippett ..... 473/237 X
5,609,530 A * 3/1997 Butler, Jr. ..... 473/237
6,254,491 B1 * 7/2001 Chou ..... 473/146 X

FOREIGN PATENT DOCUMENTS

GB 281099 * 12/1927 ..... 273/186.4
GB 2251800 * 7/1992 ..... 273/186.4
JP 35/2012046 * 1/1977 ..... 273/186.4

* cited by examiner

*Primary Examiner*—Raleigh W. Chiu

(57) ABSTRACT

The invention is a portable, self-contained apparatus that will easily mark a practice golf ball with a water-soluble substance. This mark will transfer to the face of any club when the golf ball is struck and will show a golfer exactly where he/she is striking the ball on the face of the club. The ball rotates in a circular horizontal direction when struck. It then rolls over the marker as it is returned to the striking position. The object of the device is to consistently put the mark on the face of the club directly on the "sweet spot" (center of the face of the club). This will enable a golfer to correct mistakes and improve both the long and short games (including putting).

2 Claims, 4 Drawing Sheets

GOLF PRACTICE DEVICE WITH MARKING WHEEL

CROSS REFERENCE TO RELATED APPLICATIONS

The present application is a continuance of the provisional application No. 60/140,934 filed Jun. 28, 1999. The marker has been changed to a wheel centered in a container that holds the marking substance. The wheel rolls through the marking substance as the ball passes over it. The device has a disk that governs the speed of the arm and ball. The disk can be raised or lowered for driving or putting. The trough that acted as a rail has been eliminated, allowing the marker to be detachable and to be moved to left-handed or right-handed positions.

STATEMENT REGARDING FEDERALLY SPONSORED RESEARCH OR DEVELOPMENT

Not applicable

REFERENCE TO MICROFICHE APPENDIX

Not applicable

BACKGROUND OF THE INVENTION

The invention pertains to golf practice devices.

Practicing in an accurate way with a suitable practice device is the most important factor for a golfer to acquire proficiency.

There is no widely accepted marking device that allows a golfer to practice with each individual club, indoors or outdoors. This invention can teach a golfer to consistently hit the ball on the "sweet spot" (center of the face of the club).

BRIEF SUMMARY OF THE INVENTION

This invention has several points in favor. First and foremost is the ability to mark the face of the club in such a manner that will immediately show the golfer where he/she is making contact with the club. The benefits of seeing precisely where the impact is on the club will facilitate the correction of slicing, hooking, topping, or hacking.

Another advantage is its portability. It can be used indoors or outdoors, with or without golf shoes (excluding metal cleats).The lightweight arm and golf ball enable a golfer to learn how to hit a golf ball correctly without wearing out expensive clubs.

The water soluble marking substance is readily washed from the mat with a garden hose. The mark that is transferred to the club can be wiped easily from the face of the club with the hand or a cloth.

Use of this invention will teach a golfer to be able to stand and be comfortable at the proper distance from the golf ball in order to hit the golf ball on the center of the face of the club. This will improve all phases of the golfer's game, from driving from the tee to the putting on the green.

DETAILED DESCRIPTION OF THE INVENTION

Figure 1:
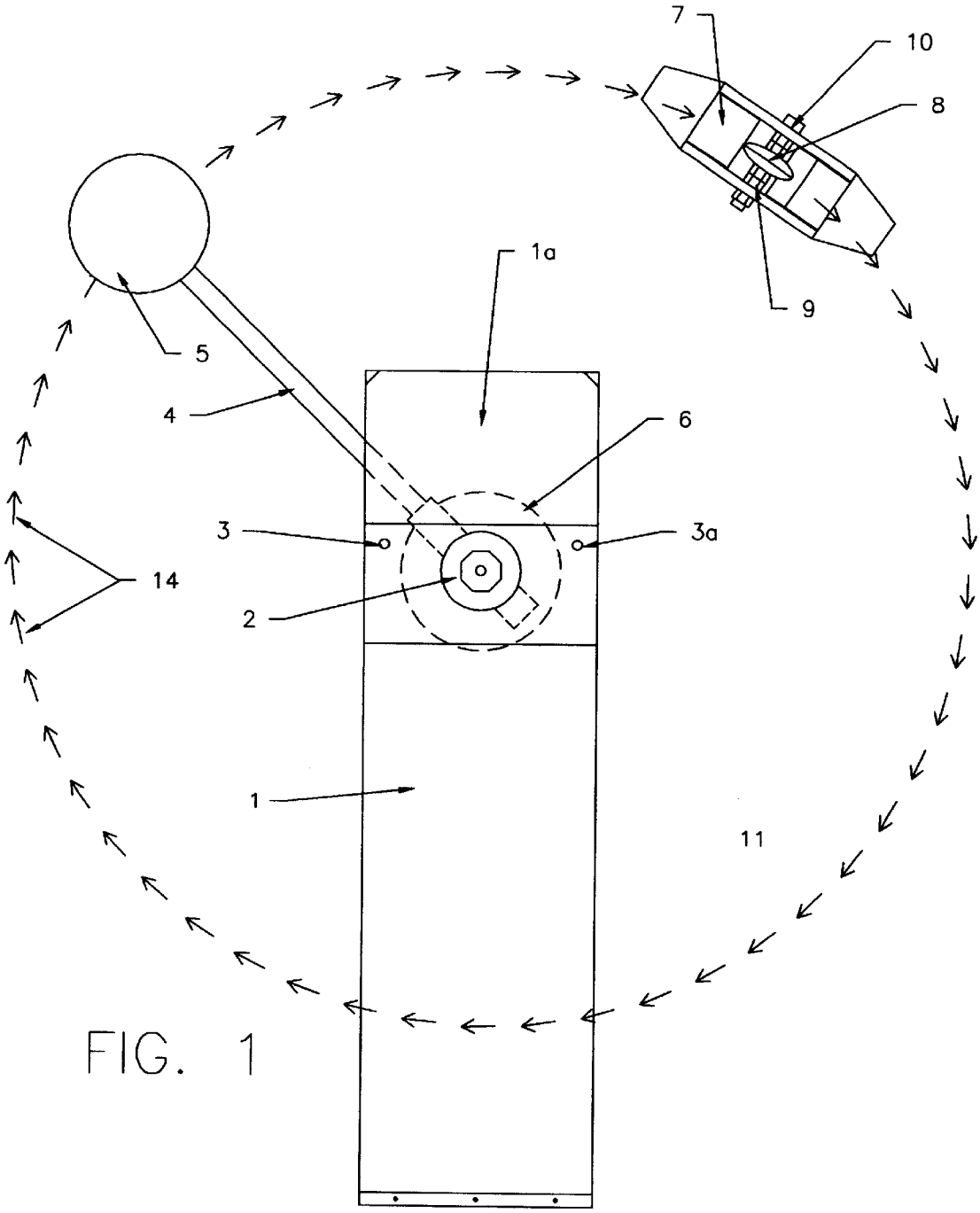
FIG. 1 Top view of the marking device showing the top cover, with curved pressure portion, center pin, stoppers, arm and golf ball, disk, marker and snaps FIG. 2 Side view of the marking device showing the top cover with curved pressure portion, center pin, arm and golf ball, disk, mat and support base FIG. 3 Perspective view of the marking device showing the top cover with curved pressure portion, center pin, stoppers, arm and golf ball, disk, container, mat and support base FIG. 4 Top view of marker and container showing the container, wheel, nuts and support pin FIG. 5 Cut-away view of marker and container showing the container, wheel, support pin, snaps, marking substance FIG. 6 View of marker from the bottom showing the container, snaps, nuts and support pin
Figure 2:
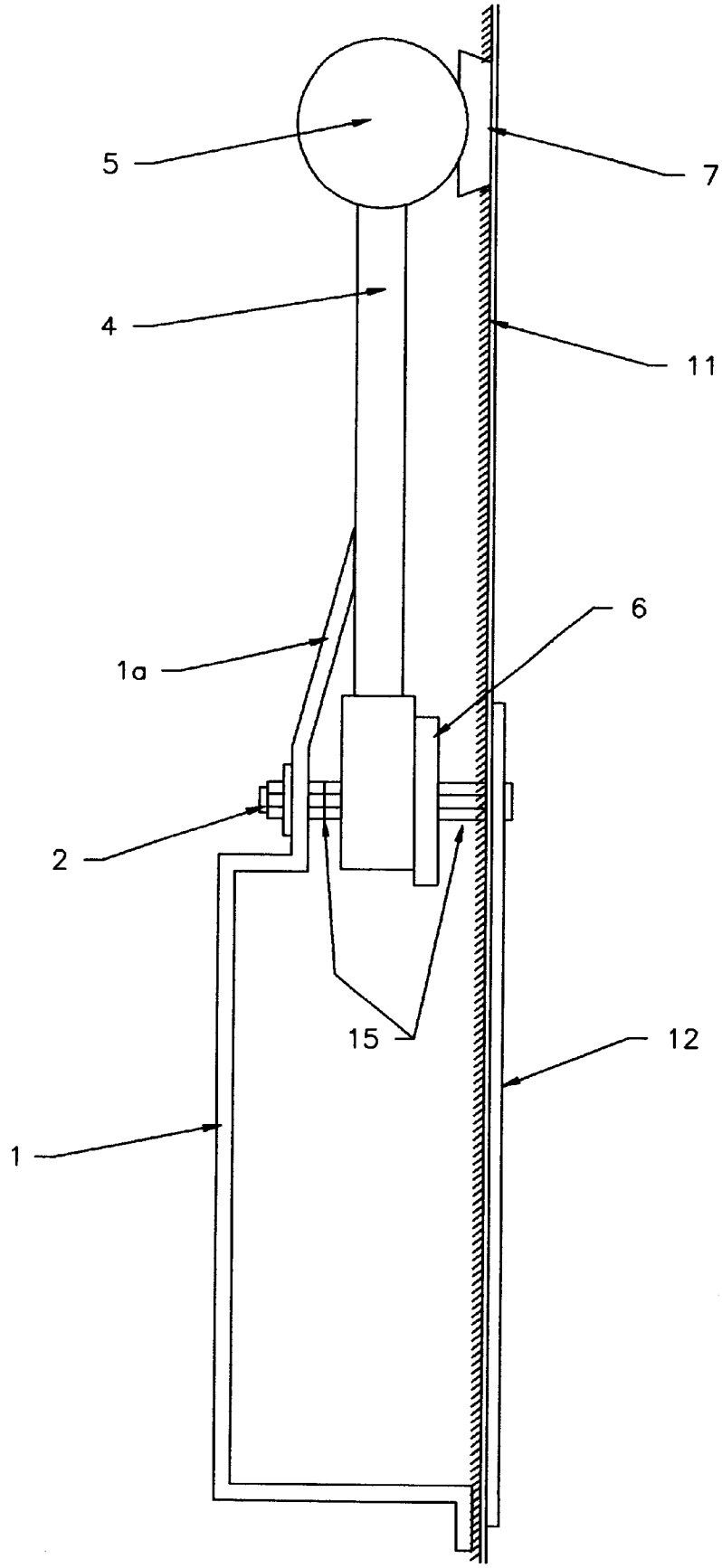
Figure 3:
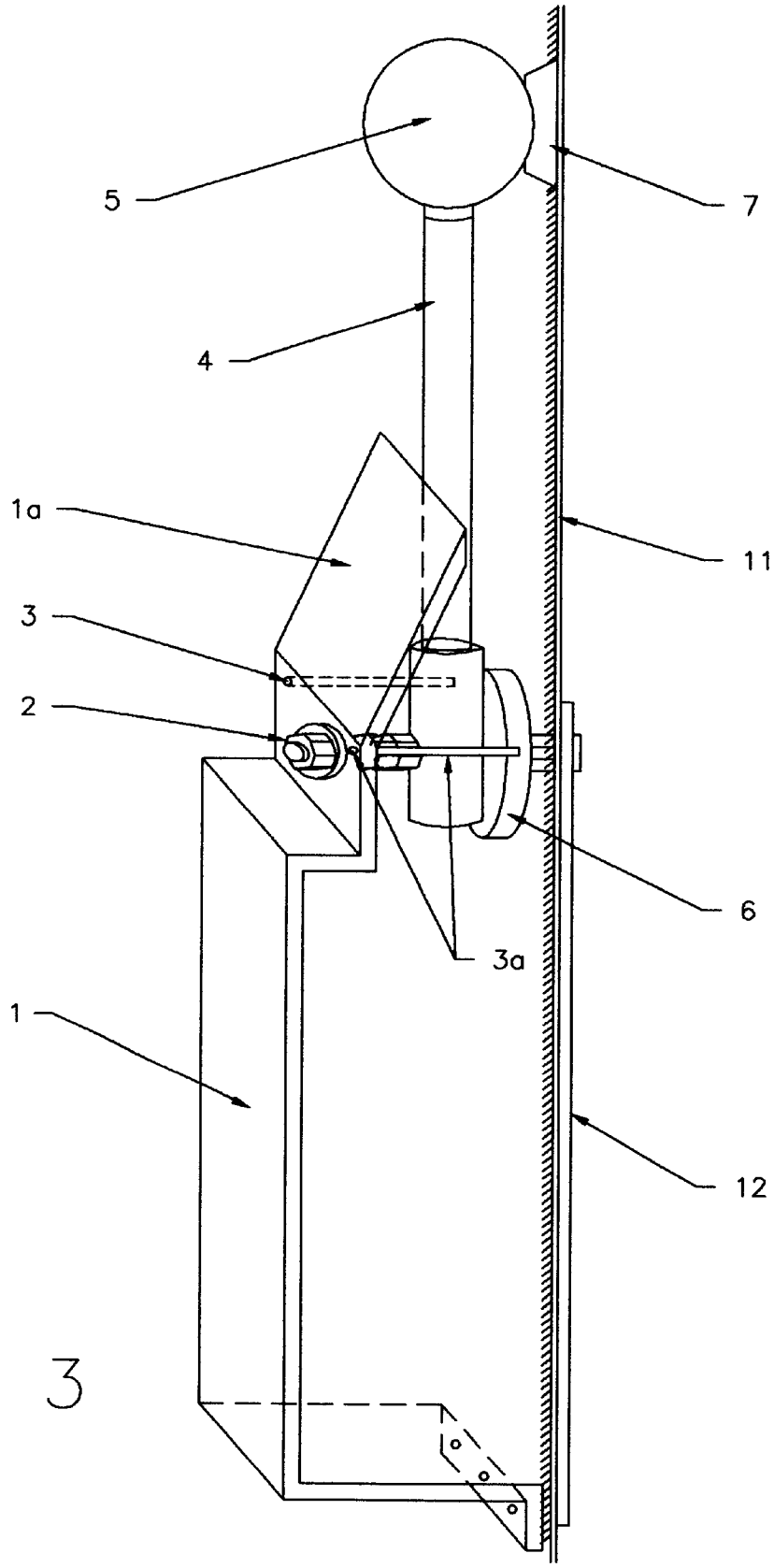
Figure 4:
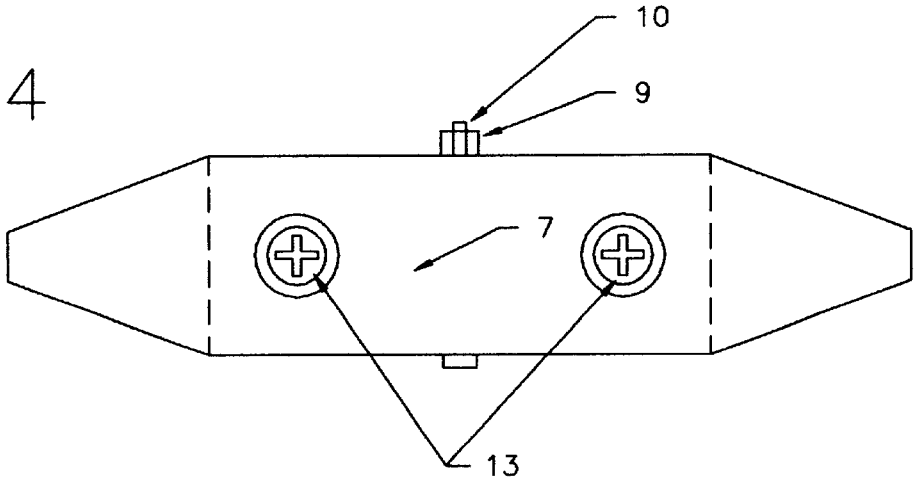
Figure 5:
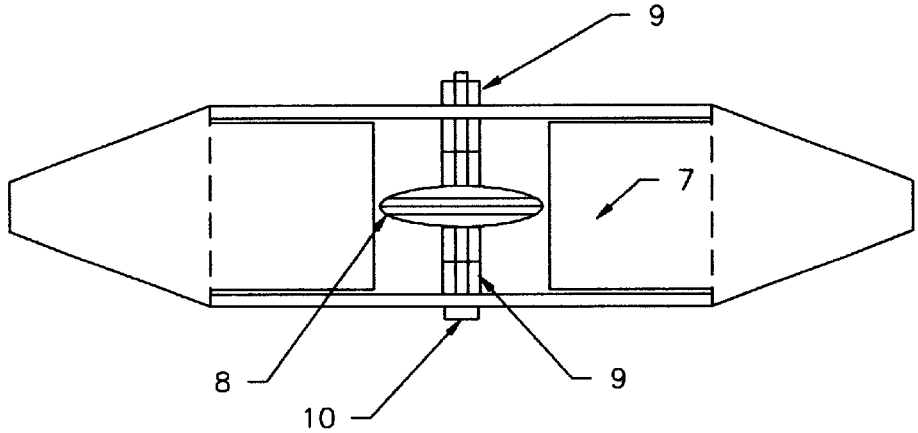
Figure 6:
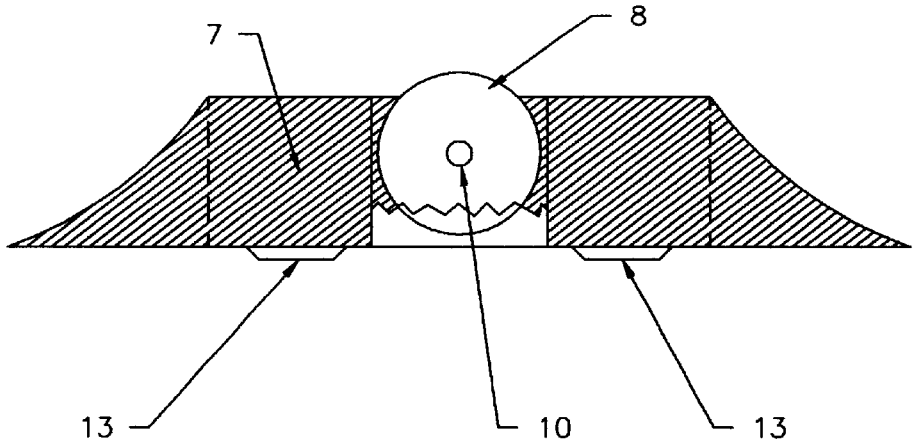

The invention will now be described with reference to the drawings.

TOP COVER FIG. 1

The top cover 1 stabilizes the center pin 2 and holds the stoppers 3 and 3*a* to position the golf ball 5 for both marking and striking. The downward curve of the top cover 1*a*, is the portion that applies adjustable downward tension on the arm 4 and golf ball 5 to ensure proper marking.

CENTER PIN FIG. 1

The center pin 2 supports and acts as a fulcrum for the arm 4 and golf ball 5. It supports the top cover 1, allowing for an easily adjustable tension on the arm 4 and golf ball 5 for marking purposes. It also supports the disk 6 that controls the speed and elevation of the arm 4 and golf ball 5.

STOPPERS FIG. 1

There are two stoppers located on each side of the center pin 2. The first stopper 3, helps to slow the arm 4 and golf ball 5 so that it can be marked properly. The second stopper 3*a* stops the golf ball 5 in the proper position for striking.

ARM AND GOLF BALL FIG. 1

The golf ball 5 rotates as the arm 4 and golf ball 5 move in a horizontal circular motion when the golf ball 5 is hit. The arm 4 and golf ball 5 are slowed down by the first stopper 3 to allow the golf ball 5 to be marked. The golfer, then guides the arm 4 and golf ball 5, (manually with the club or by hand) over the marker 8. When the arm 4 and golf ball 5 reach the second stopper, the mark on the golf ball 5 is in the proper position for striking.

The arm 4 and golf ball 5 is made of resilient light-weight material.

SNAPS FIG. 1

There are two sets of snaps 14 located on the mat 11 in the direct path of the golf ball 5. These snaps allow the marker to be moved from right-handed to left-handed positions.

DISK FIG. 2

The disk 6 is located on the center pin 2 directly below the arm 4 and golf ball 5. The disk 6 controls the speed of the arm 4 and golf ball 5. It can be raised or lowered, depending on whether the golfer wishes to practice driving or putting.

MAT FIG. 2

The mat 11 enables the mechanisms of the invention to be attached in a secure, proper position. Made of a resilient, durable material that simulates grass, the mat 11, also serves as a protection against damage to golf clubs or flooring.

SUPPORT BASE FIG. 3

The support base 2 is the same width as the top cover 1. It is located under the mat 11 immediately below the top cover 1. The purpose of this support base is to give added stability to the top cover 1 and the center pin 2.

THE UNDERSIDE OF THE CONTAINER FIG. 4

The container 7 that holds the marker 8 and the marking substance has snaps 13 on the bottom. This allows the marker to be moved from right-handed to left-handed position.

THE MARKER FIG. 5

Secured in place by a support pin 10 and nuts 9, the marker is a wheel 8 that rotates in a vertical position through a water soluble substance as the golf ball 5 is guided over it.

The marker 8 leaves a very precise mark on the golf ball 5 and when the golf ball is struck, the mark is transferred to the face of the golf club.

THE CONTAINER FIG. 6

The wheel 8 is centered in a container 7 that holds a water-soluble substance.

This marking device in accordance with the invention will be constructed of light weight materials and is designed to be very cost efficient. Easily replaceable, inexpensive parts (i.e. the arm and golf ball) should they be needed, will make this invention very affordable for all golfers.

What I claim as my invention is:

1. a golf marking device for a player to improve the player's consistency and accuracy during practice and thereby improve the player's overall game of golf comprising:

a base, a top cover with a curved pressure portion to which a center pin is anchored in a vertical position;

two stoppers located on the top cover to help control the speed of the arm and ball as it enters and passes over a marking means;

a horizontally positioned arm attached at one end to the center pin and at the other end to a practice ball, so that when the ball is struck by the players club, the ball rotates in a circular horizontal direction and passes over the marking means as it is returned to the striking position;

a disk that fits over the center pin, which governs the speed of the arm and ball, that can be raised or lowered for driving or putting.

2. The golf marking device of claim 1 whereby the means of marking the ball comprises;

a wheel that rotates in a vertical position, which is centered in a container, that holds a marking substance;

wherein the marking means can be positioned for right-handed or left-handed golfers.

* * * * *